US011486099B2

(12) United States Patent
Boczkiewicz et al.

(10) Patent No.: US 11,486,099 B2
(45) Date of Patent: Nov. 1, 2022

(54) RAIL PLATE RETAINER FOR USE WITH RAIL TIE EXCHANGER

(71) Applicant: NORDCO INC., Oak Creek, WI (US)

(72) Inventors: Bruce Michael Boczkiewicz, Shorewood, WI (US); Nicholas Edward Wojnar, Oak Creek, WI (US); Gregory John Long, Mount Pleasant, WI (US); Neil Patrick Creegan, Wauwatosa, WI (US)

(73) Assignee: NORDCO INC., Oak Creek, WI (US)

( * ) Notice: Subject to any disclaimer, the term of this patent is extended or adjusted under 35 U.S.C. 154(b) by 411 days.

(21) Appl. No.: 16/549,422

(22) Filed: Aug. 23, 2019

(65) Prior Publication Data

US 2020/0087863 A1 Mar. 19, 2020

Related U.S. Application Data

(60) Provisional application No. 62/730,664, filed on Sep. 13, 2018.

(51) Int. Cl.
*E01B 29/32* (2006.01)
*E01B 29/10* (2006.01)

(52) U.S. Cl.
CPC ..... *E01B 29/32* (2013.01); *E01B 29/10* (2013.01)

(58) Field of Classification Search
CPC ..... E01B 29/10; E01B 29/32
USPC ..... 104/9, 16
See application file for complete search history.

(56) References Cited

U.S. PATENT DOCUMENTS

| | | | | |
|---|---|---|---|---|
| 4,942,822 | A | 7/1990 | Cotic | |
| 5,277,122 | A * | 1/1994 | Almaraz | E01B 29/32 104/17.2 |
| 5,617,795 | A * | 4/1997 | Glomski | E01B 29/10 104/9 |
| 5,722,325 | A * | 3/1998 | Glomski | E01B 29/10 104/9 |
| 6,463,858 | B2 | 10/2002 | Weber et al. | |
| 6,662,729 | B1 * | 12/2003 | Madison | E01B 29/32 104/17.2 |
| 6,863,717 | B2 * | 3/2005 | Johnsen | E01B 29/32 104/9 |
| 7,497,166 | B2 | 3/2009 | Fuerst et al. | |
| 8,171,855 | B2 | 5/2012 | Noll et al. | |
| 8,522,688 | B2 * | 9/2013 | Pritzl | E01B 29/32 104/17.2 |
| 2003/0005850 | A1 * | 1/2003 | Johnsen | E01B 29/10 104/9 |
| 2011/0308421 | A1 * | 12/2011 | Pritzl | E01B 29/32 104/17.2 |

(Continued)

*Primary Examiner* — Zachary L Kuhfuss
(74) *Attorney, Agent, or Firm* — Greer, Burns & Crain, Ltd

(57) ABSTRACT

A plate retainer apparatus is provided for use on a railroad track with a tie exchanger having a main frame, the apparatus configured for gripping and retaining rail tie plates to a rail during a rail tie exchange process. The plate retainer apparatus includes a plate retainer workhead constructed and arranged for movement independent of that of the main frame. Included on the workhead is a pair of workhead modules, each module associated with a rail of the track and configured for retaining a single tie plate associated with a target tie at a time. Each workhead module is movable relative to the main frame independently of each other.

17 Claims, 5 Drawing Sheets

(56) References Cited

U.S. PATENT DOCUMENTS

2016/0153151 A1* 6/2016 Irion ..... E01B 29/10
104/9

* cited by examiner

RAIL PLATE RETAINER FOR USE WITH RAIL TIE EXCHANGER

RELATED APPLICATION

This application claims 35 USC 119 priority from U.S. Provisional Application Ser. No. 62/730,664 filed Sep. 13, 2018, which is incorporated by reference herein.

BACKGROUND

This invention relates generally to railway right-of-way maintenance equipment of the type used to repair and maintain railroad track. More specifically, the present invention relates to an apparatus for handling rail tie plates during replacement of rail ties.

Conventional railroad track consists of a plurality of spaced parallel wooden ties, to which are attached a pair of spaced rail tie plates. Each tie plate is configured to rest on the upper surface of the tie and includes holes for receiving spikes or screws, as well as a canted seat or a cradle formation for receiving the bottom or foot of the steel rail. Since two rails make up a railroad track, there are a pair of spaced tie plates on each tie. Some of the spikes are used to secure the tie plate on the tie, and others are used to secure the rail foot to the tie plate cradle.

During track maintenance operations, it is common to periodically remove worn out or rotten ties. This is accomplished by first removing the spikes which hold the plates to the tie as well as to the rail. Next, a machine, such as is disclosed in commonly-assigned U.S. Pat. No. 6,463,858, incorporated by reference, lifts the rail and extracts the worn tie from underneath. The tie is slid transversely out from beneath the rails. As the tie is extracted, the loosened tie plates either fall into the rail bed or ballast, or are retained on the removed tie. Conventional practice is to manually remove the plates and then throw them off to the side of the ballast so they do not interfere with the replacement procedure of the new tie.

One system for handling the plates automatically during the tie replacement process is disclosed in commonly-assigned U.S. Pat. No. 6,863,717 which is incorporated by reference. Using this machine, the tie plates are grasped at the forward and rear edges with respect to the direction of travel along the track and are held suspended above the rails while the tie is extracted.

Another approach to the problem of tie plate handling is disclosed in U.S. Pat. No. 5,722,325. In this machine, the tie plates are grasped and held to the rail while the tie is extracted. A pair of jaws grasp the target tie plate along the forward and rear side edges with respect to the direction of travel on the track. A fluid-powered, preferably hydraulic cylinder is connected to both jaws to exert the gripping force. In practice, this apparatus has encountered difficulty in centering the force on the target plate, which has interfered with efficient plate handling. Also, the mechanism disclosed in the '325 patent has proved difficult to use when the tie plates are not aligned on the tie, which often occurs in lengths of curved track, or when ties are subject to warping.

SUMMARY

The above-listed need is met or exceeded by the present rail plate retainer for use with a rail tie exchanger. One feature of the present plate retainer is a workhead assembly that is movable along the track independently of the tie exchanger. Included on the workhead assembly is a pair of track plate workhead modules, one workhead module associated with each rail. Each of the modules is movable along the track independently of the other module to better account for misaligned plates on the ties, or for curved sections of track. An associated fluid power cylinder controls the movement of each workhead module relative to a main tie exchanger machine frame.

Each workhead module has a pair of guide wheels facilitating movement of the module relative to the adjacent workhead module. Also, the modules are connected to each other with hinged plates which accommodate the relative movement of the workhead modules. In the preferred embodiment, there are two pairs of hinge plates, one pair forward of the target tie, and the other pair rearward of the target tie.

Another feature of the present tie plate handler is at least one pair of jaws on each module configured for grabbing the tie plate along the forward and rear side edges. The gripper mechanism is held in an elevated travel position until the module reaches the target tie to be removed. Upon reaching the target tie and tie plate, the jaws, mounted on a pivoting arm, are lowered, and the jaws closed by a single fluid power cylinder on each workhead module. Each jaw is pivotally mounted to the arm of the workhead module, and the pair of jaws are synchronized by providing meshing teeth on complementary edges of the jaws associated with each plate. In the preferred embodiment, there are two pivoting arms, and four jaws associated with each plate, one pair on the gauge side, and one pair on the field side of each rail. A first fluid power cylinder is activated to close the jaws upon the plate, and another cylinder acts on the arm to lift it slightly and hold it against the rail while the tie is replaced.

Still another feature of the present tie plate handler is a retractable lock for holding the pivot arm with the tie plate gripper jaws in the elevated, travel position. One of the locks is provided on each workhead module.

Each of the gripper jaws has a plate-engaging profile that facilitates engagement and grasping of the associated tie plate edge. The profile includes a gently convex shape for engaging a top surface of the plate, and a depending tab for grasping the tie plate edge.

More specifically, a plate retainer apparatus is provided for use on a railroad track with a tie exchanger having a main frame, the apparatus configured for gripping and retaining rail tie plates to a rail during a rail tie exchange process. The plate retainer apparatus includes a plate retainer workhead constructed and arranged for movement independent of that of the main frame. Included on the workhead is a pair of workhead modules, each module associated with a rail of the track and configured for retaining a single tie plate associated with a target tie at a time. Each workhead module is movable relative to the main frame independently of each other.

In another embodiment, a plate retaining workhead is provided for use with a rail tie exchanger, and includes at least one workhead module, each module including an arm pivoting between a travel position and a work position. Each arm has at least one pair of associated jaws pivotally mounted for movement between an open position and a closed position, the jaws constructed and arranged for engaging forward and rear edges of a target tie plate. A fluid power cylinder is mounted to each pair of jaws for moving the jaws between the open and closed position.

DETAILED DESCRIPTION

Figure 1:
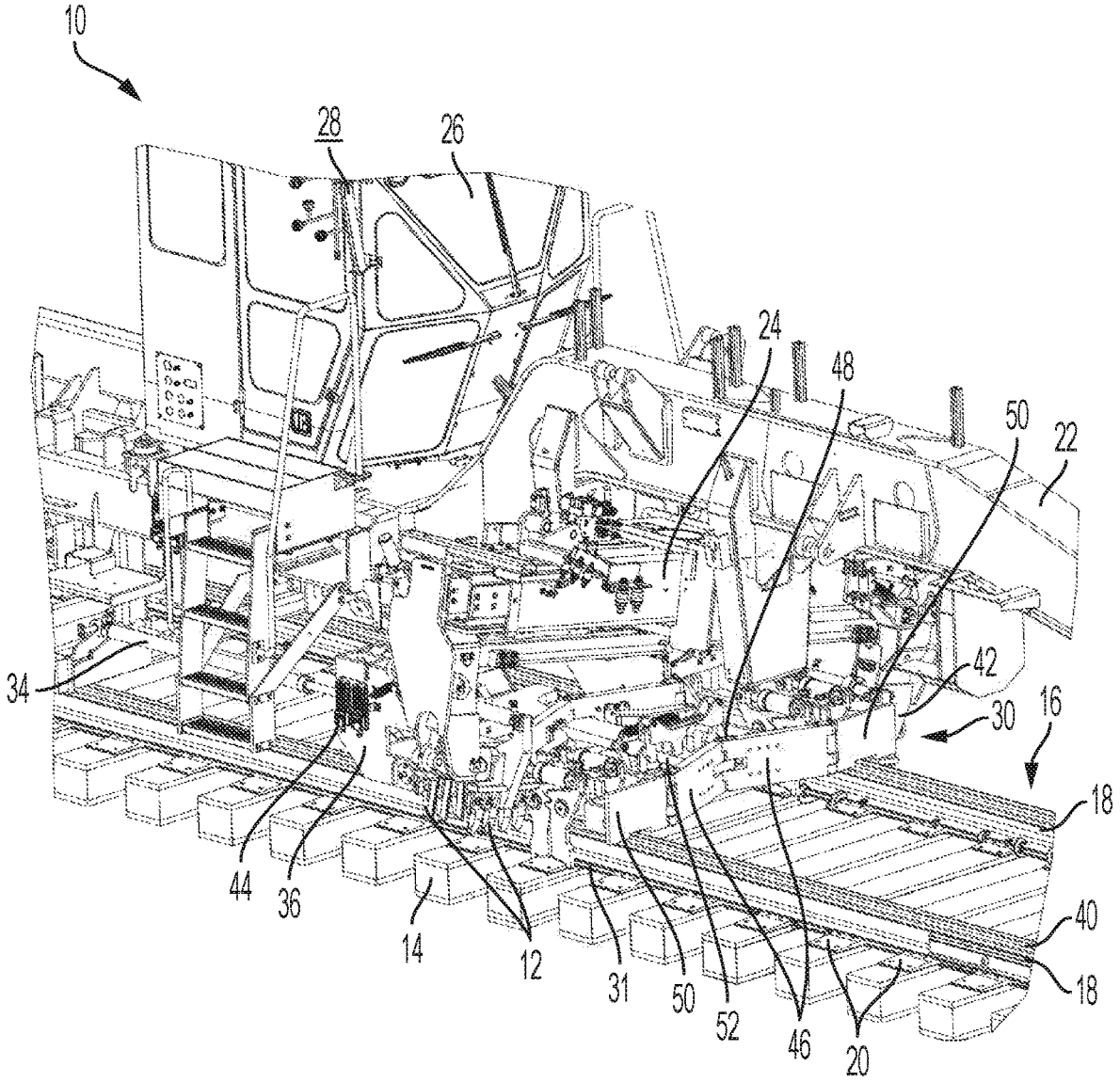
FIG. 1 is a fragmentary top perspective view of a tie exchanger equipped with the present tie plate retainer.

Referring now to FIG. 1, a tie exchanger suitable for use with the present plate retainer is generally designated 10. Features of the tie exchanger 10 are disclosed in commonly-assigned U.S. Pat. No. 6,463,858 which is incorporated by reference. As is known in the art, the tie exchanger 10 uses reciprocating tie gripper claws 12 to grasp a tie 14 of a railroad track 16. The track 16 includes a pair of rails 18, which are secured to the ties 14 with a pair of tie plates 20 on each tie. As is well known, the tie plates 20 are secured to the ties 14 with fasteners such as spikes or screws. These fasteners are removed prior to the tie extraction procedure using a separate spike remover apparatus well known to those in the art.

Also included on the tie exchanger 10 is a main frame 22 from which the gripper claws 12 are suspended via a telescoping arm 24, and an operator's cab 26 bearing a control system 28. As is well known in the art, the tie exchanger 10 is preferably movable along the track 16 using a power source (not shown), such as an internal combustion engine.

Mounted to the tie exchanger 10, preferably in operational relationship to, or beneath the telescoping arm 24 is a plate retainer workhead, generally designated 30. A main purpose of the plate retainer workhead 30 is the grabbing and retaining of at least one target tie plate 20 on a target tie 14 slated for removal. The target tie plate 20 is retained by the workhead 30 against a foot or base 31 of the rail 18 during the tie extraction and replacement procedure.

Referring now to FIGS. 1-4, a feature of the plate retainer workhead 30 is that it is independently movable relative to the main frame 22. Further, the plate retainer workhead 30 includes a pair of workhead modules 32, each module is associated with a respective one of the rails 18, and as described in greater detail below, is configured for retaining a single tie plate 20 associated with a target tie 14 at a time. Also, each workhead module 32 movable relative to the main frame 22 independently of each other.

Each workhead module 32 is independently connected to the main frame 22 via a fluid-powered, preferably hydraulic cylinder 34. Extension and retraction of the cylinders 34 move the respective modules 32 forward or backward relative to the main frame 22 in the direction of travel along the track 16. Also, each workhead module 32 has a module frame 36 which has at least one and preferably a pair of guide wheels 38 configured for rotatably engaging a head 40 of the rail 18.

Independent movement of the modules 32 is considered an advantage when the plates 20 on a target rail tie 14 are not in full alignment, such as from the tie being warped or positioned on a non-perpendicular angle relative to the rails 18. Tie plates 20 are also typically not in alignment in lengths of curved track 16. In the present plate retainer workhead 30, the operator, using the control system 28, activating the module cylinders 34 moves the workhead modules 32 independently of each other for achieving proper orientation for retaining the respective tie plates 20 on each rail 18 against the rail during the tie extraction and replacement procedure.

Figure 3:
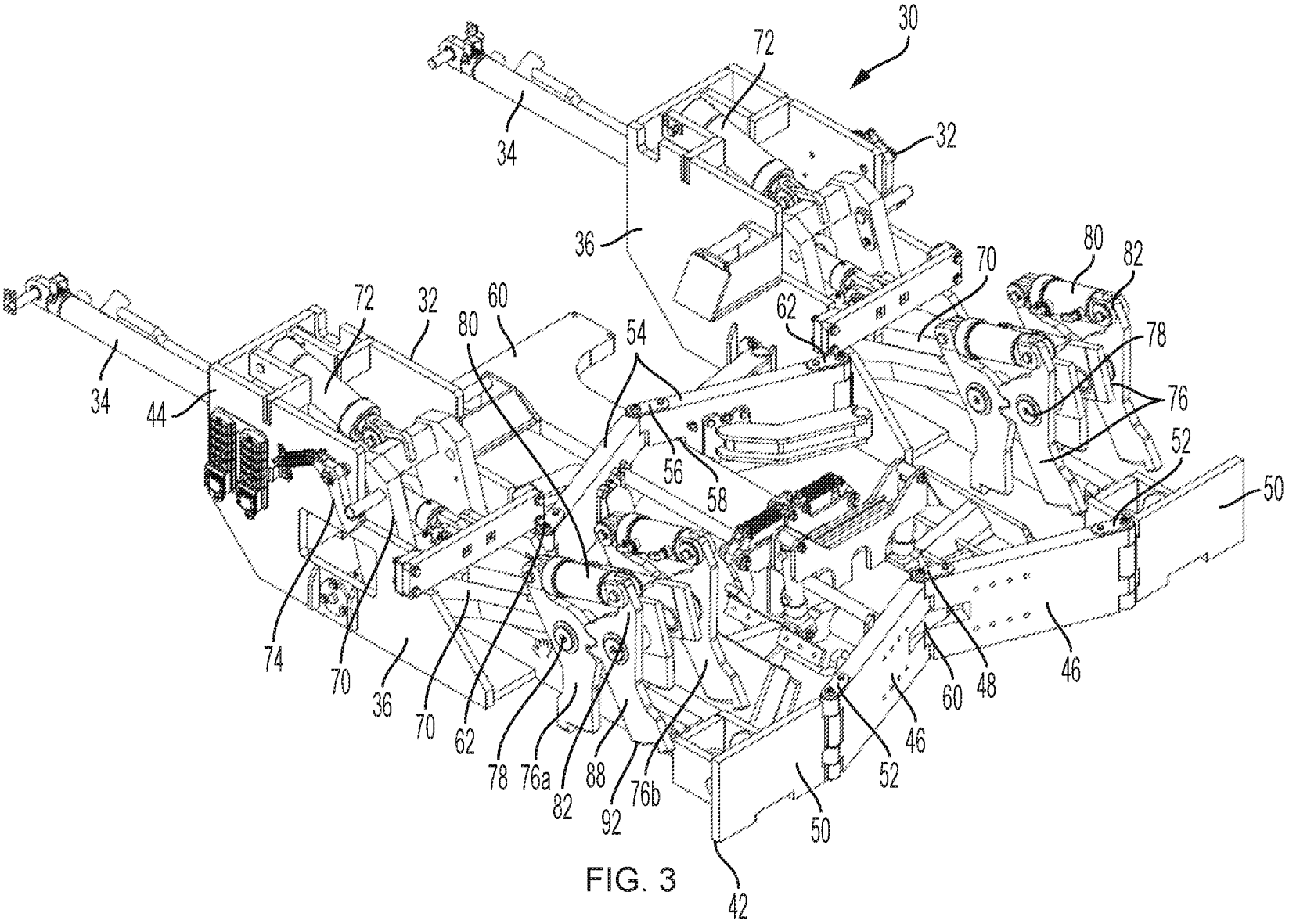
FIG. 3 is a fragmentary front perspective of the present tie plate retainer, including the two workhead modules in the travel position.
Figure 4:
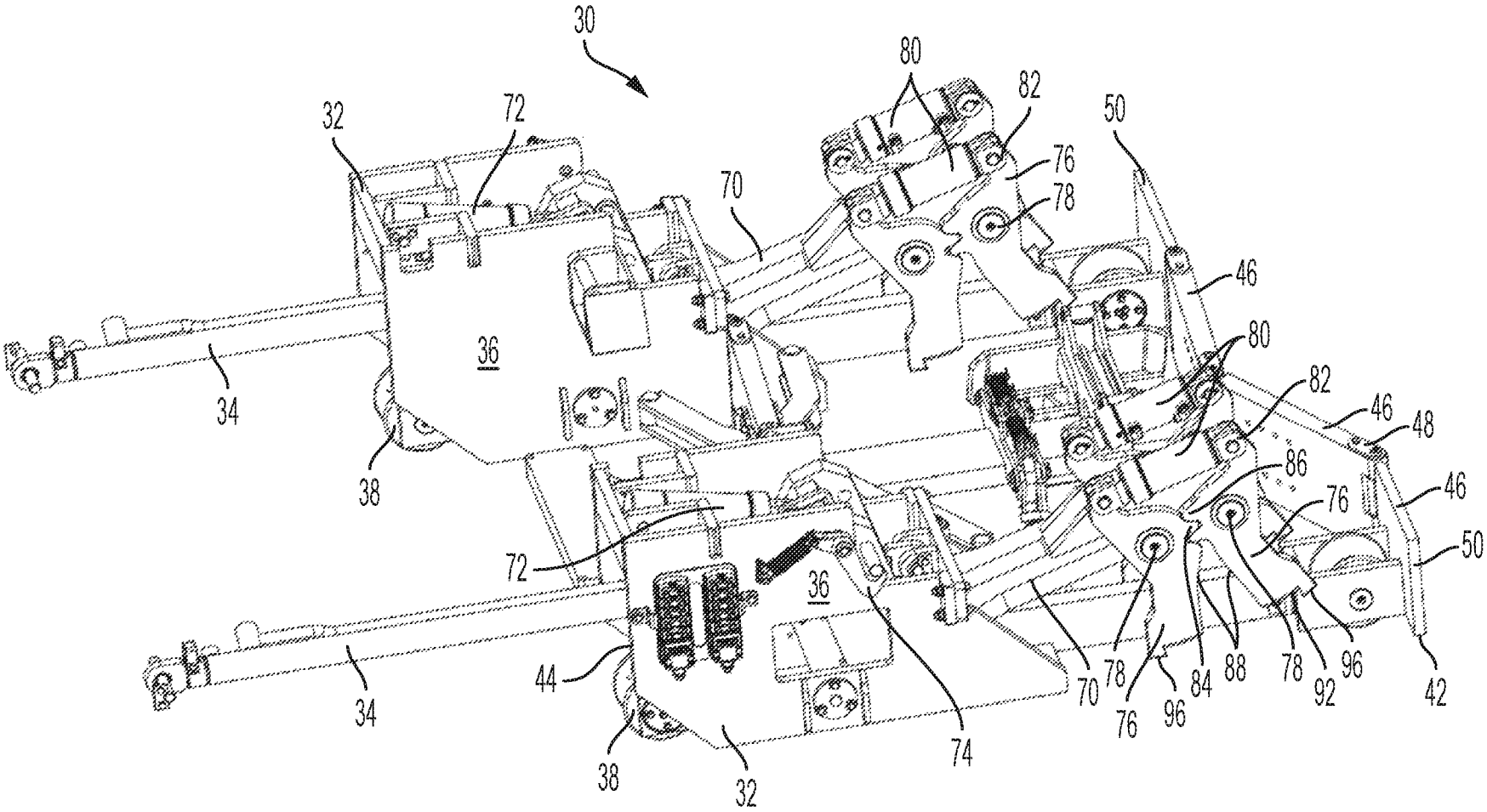
FIG. 4 is a fragmentary top perspective of the present tie plate retainer of FIG. 3, showing the workhead modules linearly displaced relative to each other.

Referring now to FIGS. 1, 3 and 4, in the preferred embodiment, the workhead modules 32 are connected to each other at at least one of a forward end 42 and at or near a rear end 44 of each module, straddling the target rail tie 14. Preferably at each of the forward ends 42, the modules 32 are provided with a pair of forward hinge plates 46, connected to each other at adjacent free ends by a vertically oriented central hinge pin 48, and each hinged to a front plate 50 of the module by a hinge pin 52. At the rear end 44, a pair of rear hinge plates 54 are connected to each other by a central hinge pin 56, and are also configured with notches 58 for slidingly accommodating a horizontal support bar 60 secured to the module frame 36. Each of the rear hinge plates 54 is connected to the corresponding module frame 36 using hinge pins 62. It is also preferred that the front central hinge pin 48 also engages the support bar 60. The hinge plates 46 and 54 limit the independent movement of the modules 32 relative to each other.

Figure 2:
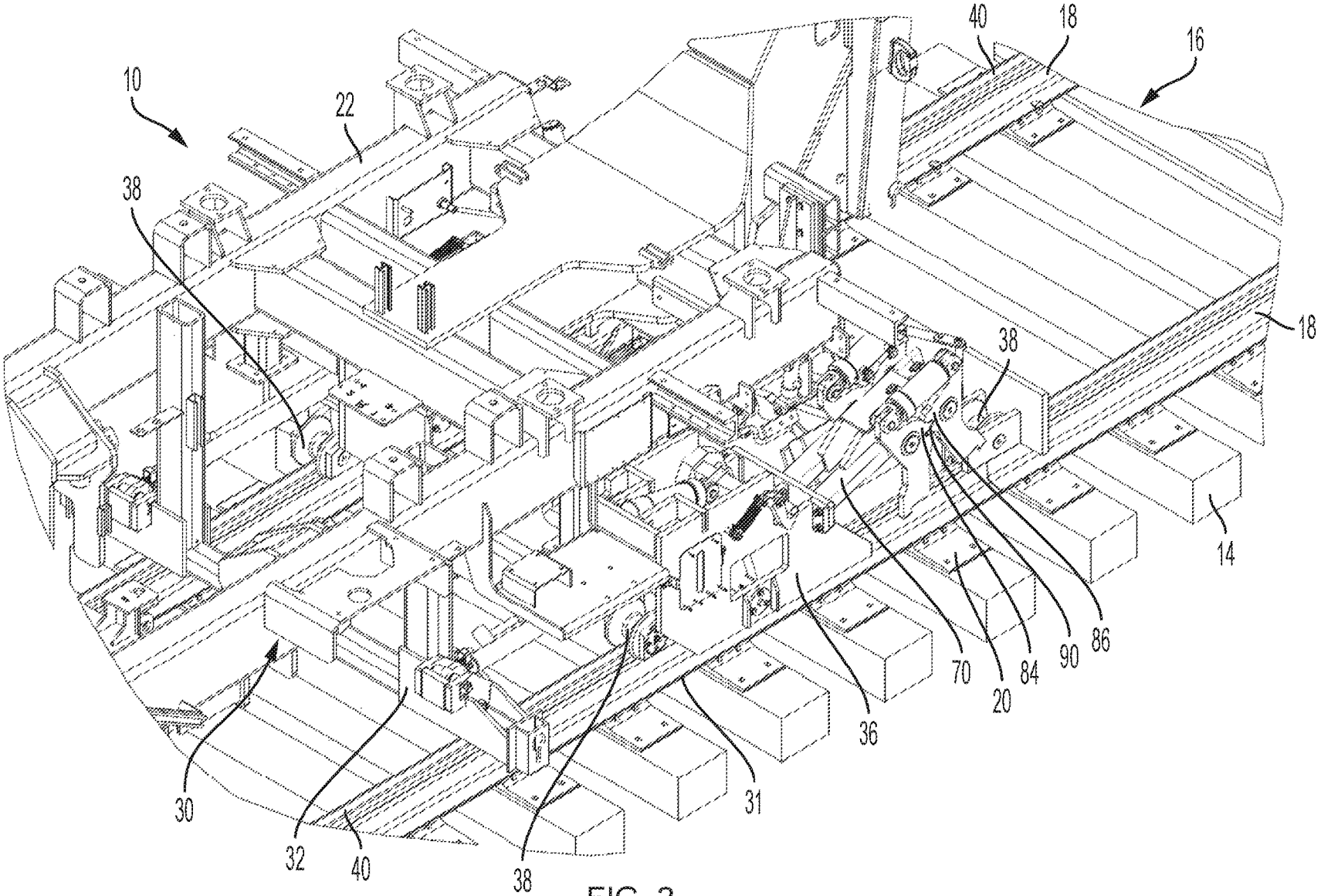
FIG. 2 is a fragmentary top perspective view of the present tie plate retainer including a pair of workhead modules shown in the travel position.

Also seen in FIGS. 2-4, each workhead module 32 has at least one jaw arm 70 pivotally mounted to the workhead module frame 36 and controlled by a fluid power, preferably hydraulic jaw arm cylinder 72 connected between the arm 70 and the module frame 36. Extension and retraction of the jaw arm cylinder 72 moves the arm 70 between a lowered work position and a raised travel position. Also included on the module frame is a retractable or releasable lock configured for releasably retaining the jaw arm 70 in the travel position.

Figure 5:
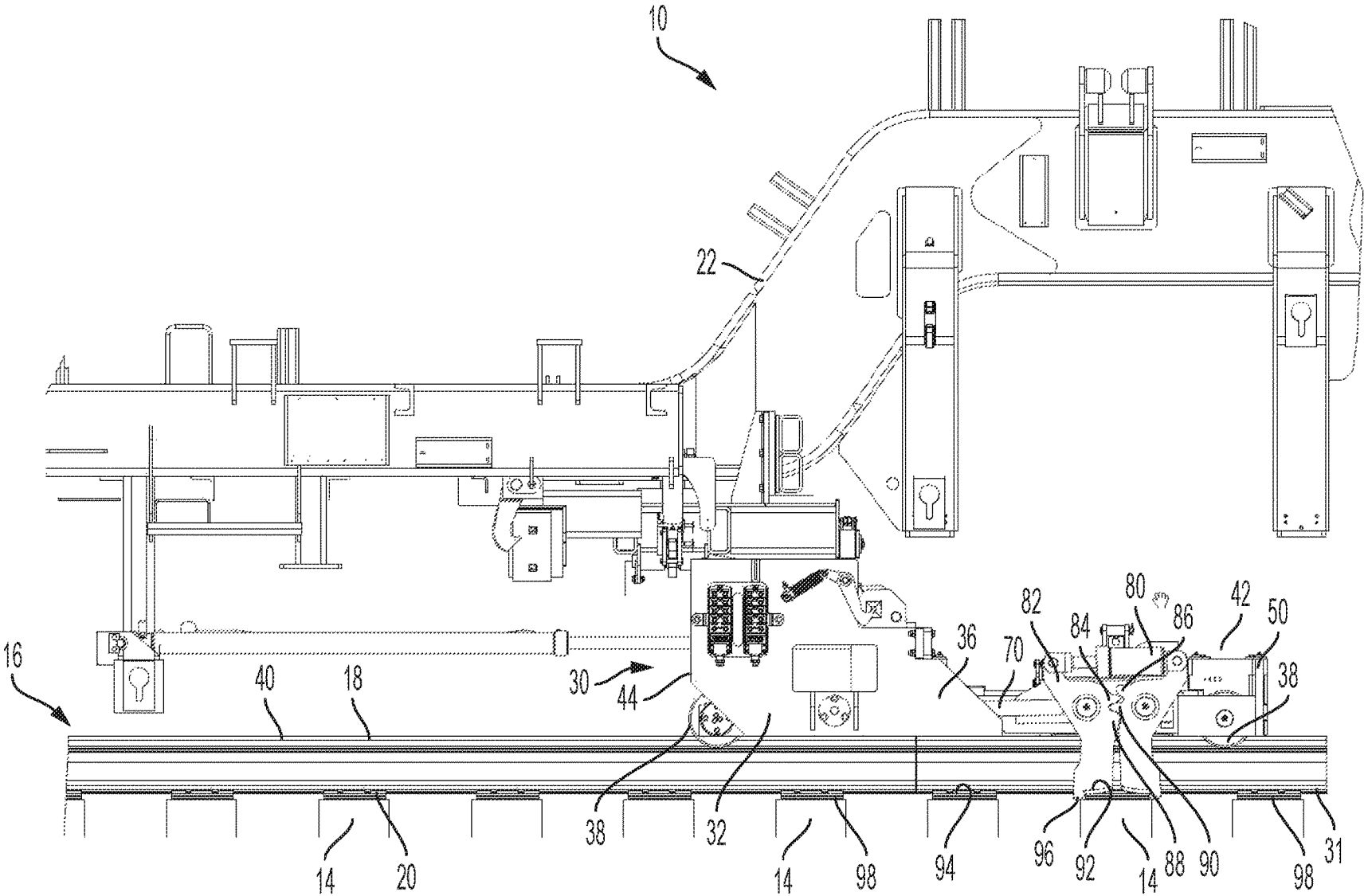
FIG. 5 is a fragmentary side view of the tie exchanger of FIG. 1 showing the workhead module with the jaws in the tie retaining position.

Each jaw arm 70 has at least two plate gripping jaws 76, each jaw pivots relative to the jaw arm about a pivot point or bearing 78 between an open position (FIG. 3) and a closed position (FIG. 5). A fluid-powered, preferably hydraulic jaw cylinder 80 connects upper ends 82 of each gripping jaw 76, and when extended puts the jaws in the closed position, and when retracted puts the jaws in the open position. As seen in FIGS. 2-4, each jaw arm 70 is associated with four jaws 76, two jaws **76*a* associated with a field side of the plate 20, and two jaws 76*b* associated with a gauge side of the plate (FIG. 3). As discussed above, each workhead module 32 is associated with one tie plate 20 on the target tie 14. Using the control system 28, the operator controls the jaw arm cylinder 72 and the jaw cylinders 80 for each workhead module 32 for tightly grasping the target tie plates 20. Also, during the tie replacement process, the jaw arm cylinder 72 is retracted to pull the arm 70 upward, which holds the tie plate 20 held by the jaws 76 against the rail 18**.

Referring now to FIGS. 2-5, each pair of the jaws 76 has meshing teeth 84, 86 on complementary facing edges 88. In the preferred embodiment, a single meshing tooth 84 on one jaw engages a pocket 90 (FIGS. 2 and 5) between a pair of teeth 86. However, other meshing arrangements are contemplated. The use of the meshing teeth, 84, 86 has proven to move the jaws 76 in a more synchronized, simultaneous movement in gripping the target tie plate 20.

Referring now to FIGS. 4 and 5, each jaw 76 is provided with a generally convex plate engaging surface 92 which engages a top surface 94 of the plate 20. The jaw 76 also has a depending plate edge-engaging tab 96, depending from an edge of the jaw, and which is configured for engaging a corresponding edge 98 of the plate.

While a particular embodiment of the present rail plate retainer for use with a rail tie exchanger has been described herein, it will be appreciated by those skilled in the art that changes and modifications may be made thereto without departing from the invention in its broader aspects and as set forth in the following claims.

The invention claimed is:

1. A plate retainer apparatus for use on a railroad track with a tie exchanger having a main frame, said apparatus configured for gripping and retaining rail tie plates to a rail during a rail tie exchange process, comprising:

a plate retainer workhead constructed and arranged for movement independent of that of the main frame;

said workhead including a pair of workhead modules, each said module associated with a rail of the track and configured for retaining a single tie plate associated with a target tie at a time, wherein each said module has at least one jaw arm pivotally moving between a travel position and a work position, each said jaw arm having at least two jaws pivotally mounted to each said jaw arm, wherein said at least two jaws each move between an open position and a closed position; and each said workhead module being independently movable relative to the main frame and independently of each other.

2. The plate retainer apparatus of claim 1 wherein said modules are hingedly connected to each other.

3. The plate retainer apparatus of claim 2, wherein said modules are connected to each other by pairs of hinge plates located on a forward and rear side of the target tie.

4. The plate retainer apparatus of claim 1, further including fluid power cylinders connecting each said module to the main frame.

5. The plate retainer apparatus of claim 1 further including guide wheels on each said module for engaging a respective rail.

6. The plate retainer apparatus of claim 1 further including a lock on said module for releasably retaining said jaw arm in the travel position.

7. The plate retainer apparatus of claim 1 further including four jaws associated with each target rail plate.

8. The plate retainer apparatus of claim 1, each said jaw having meshing teeth along complementary edges.

9. The plate retainer apparatus of claim 8, further including a fluid powered cylinder mounted to each pair of jaws for moving said jaws between an open and a closed position.

10. The plate retainer apparatus of claim 8, further including a plate engaging surface on each said jaw including a convex plate engaging surface, and a depending plate edge-engaging tab.

11. A plate retaining workhead for use with a rail tie exchanger, said workhead comprising:

at least one workhead module, each said module including an arm pivoting between a travel position and a work position;

each said arm having at least one pair of associated jaws pivotally mounted for movement between an open position and a closed position, said jaws each having a pivot axis that is transverse to a longitudinal axis of said at least one workhead module and constructed and arranged for engaging forward and rear edges of a target tie plate;

a fluid power cylinder mounted to each said pair of jaws for moving said jaws between the open and closed position.

12. The plate retaining workhead of claim 11, further including a lock on each said workhead module, constructed and arranged for releasably retaining said arm in the travel position.

13. The plate retaining workhead of claim 11, further including four of said jaws associated with each target tie plate, two of said jaws engaging the plate on a field side of an associated rail, and two of said jaws engaging the plate on a gauge side of the rail.

14. The plate retaining workhead of claim 11, wherein each said jaw has plate engaging surface on each said jaw including a convex plate engaging surface, and a depending plate edge-engaging tab.

15. The plate retaining workhead of claim 11, further including guide wheels on each said module for engaging a respective rail.

16. A plate retainer apparatus for use on a railroad track with a tie exchanger having a main frame, said apparatus configured for gripping and retaining rail tie plates to a rail during a rail tie exchange process, comprising:

a plate retainer workhead constructed and arranged for movement independent of that of the main frame;

said workhead including a pair of workhead modules, each said module associated with a rail of the track and configured for retaining a single tie plate associated with a target tie at a time;

each said module having at least one jaw arm pivotally moving between a travel position and a work position, each said jaw arm including at least two jaws pivotally mounted to each said jaw arm, wherein said at least two jaws each move between an open position and a closed position; and each said workhead module being movable relative to the main frame independently of each other.

17. A plate retainer apparatus for use on a railroad track with a tie exchanger having a main frame, said apparatus configured for gripping and retaining rail tie plates to a rail during a rail tie exchange process, comprising:

a plate retainer workhead constructed and arranged for movement independent of that of the main frame;

said workhead including a pair of workhead modules, each said module associated with a rail of the track and configured for retaining a single tie plate associated with a target tie at a time, each said module including at least one pair of jaws, wherein said at least one pair of jaws having meshing teeth along complementary edges, each said jaw including a convex plate engaging surface, and a depending plate edge-engaging tab; and each said workhead module being independently movable relative to the main frame and independently of each other.

* * * * *